US010695258B1

(12) United States Patent
Johnson

(10) Patent No.: US 10,695,258 B1
(45) Date of Patent: Jun. 30, 2020

(54) TESSELLATED MASSAGE ROLLER

(71) Applicant: Ronald B. Johnson, Honokaa, HI (US)

(72) Inventor: Ronald B. Johnson, Honokaa, HI (US)

( * ) Notice: Subject to any disclaimer, the term of this patent is extended or adjusted under 35 U.S.C. 154(b) by 968 days.

(21) Appl. No.: 15/257,404

(22) Filed: Sep. 6, 2016

(51) Int. Cl.
*A61H 15/00* (2006.01)

(52) U.S. Cl.
CPC ..... *A61H 15/00* (2013.01); *A61H 2015/0014* (2013.01); *A61H 2201/1261* (2013.01); *A61H 2201/1695* (2013.01)

(58) Field of Classification Search
CPC ..... A61H 15/00; A61H 2201/0157; A61H 2201/1253; A61H 2201/1284; A61H 2201/1671; A61H 2201/1692; A61H 2201/1695; A61H 1/00; A61H 15/0092; A61H 2203/0443; A61H 2205/10; A61H 2015/0057; A61H 2201/1261; A61H 2201/1623; A61H 2205/081; A61H 2201/164; A61H 2205/086; A61H 2205/088; A61H 2015/0014; A61H 2015/0007; A61H 2015/0021; A61H 7/007; A61H 7/008
See application file for complete search history.

(56) References Cited

U.S. PATENT DOCUMENTS

| | | | | |
|---|---|---|---|---|
| 655,490 | A | 8/1900 | Hollem | 601/135 |
| D35,855 | S | 4/1902 | Bailey | |
| 1,726,560 | A | 9/1929 | Hassler | 601/136 |
| 1,811,764 | A | 6/1931 | Sherwood | |
| 2,273,710 | A | 2/1942 | Klaes | 601/119 |
| 2,286,324 | A | 6/1942 | Wentz | |
| 2,546,095 | A | 3/1951 | Walter | |
| 3,037,500 | A * | 6/1962 | Daugherty | A61H 15/00 601/121 |
| 3,548,814 | A | 12/1970 | Montgomery et al. | |
| 4,067,324 | A | 1/1978 | Greenawalt | |
| D249,551 | S | 9/1978 | Greenawalt | |
| 4,167,940 | A | 9/1979 | Ruf | |
| 4,210,135 | A | 7/1980 | Deuser | |
| D256,841 | S | 9/1980 | Corbett et al. | |

(Continued)

FOREIGN PATENT DOCUMENTS

| | | |
|---|---|---|
| JP | 3118557 U | 2/2006 |

OTHER PUBLICATIONS

Muscleroll—Biowellnesssolutions.com—2008.
Power Systems 2009 Product Catalog—p. 73.

*Primary Examiner* — Quang D Thanh
(74) *Attorney, Agent, or Firm* — Booth Udall Fuller, PLC

(57) ABSTRACT

A massage roller may include a hollow cylindrical body with a cylindrical core and a plurality of massage protrusions each extending outwardly from the cylindrical body. Each massage protrusion may be substantially centered within a different polygonal region of a polygonal tessellation of the surface of the cylindrical body. The massage protrusions each may have a base, a filleted peripheral edge extending around the base, a concave cap opposite the base, and a plurality of walls equal in number to the edges of the polygonal region in which the protrusion is substantially centered. Each massage protrusion may also include an axial cross-section which is substantially polygonal, and has the same number of edges as and is substantially aligned with the polygonal region in which the protrusion is substantially centered.

6 Claims, 14 Drawing Sheets

(56) References Cited

U.S. PATENT DOCUMENTS

| | | | | |
|---|---|---|---|---|
| 4,345,387 | A | 8/1982 | Daswick | 36/43 |
| 4,378,007 | A | 3/1983 | Kachadourian | |
| D285,117 | S | 8/1986 | Snyder | |
| 4,846,159 | A | 7/1989 | Anzai | |
| 4,907,355 | A | 3/1990 | Allen et al. | 36/131 |
| 4,945,900 | A | 8/1990 | Masuda | |
| 4,955,914 | A | 9/1990 | Caniglia et al. | |
| D345,610 | S | 3/1994 | Shih | |
| D357,952 | S | 5/1995 | Chen | |
| D361,132 | S * | 8/1995 | Lee | D24/200 |
| D369,414 | S * | 4/1996 | Lee | D24/200 |
| D371,202 | S | 6/1996 | Zajas et al. | |
| D382,972 | S | 8/1997 | Huang | |
| 5,735,804 | A | 4/1998 | Chan | 601/136 |
| 5,824,013 | A | 10/1998 | Allen | 606/240 |
| 5,947,666 | A | 9/1999 | Huang | |
| D417,319 | S | 11/1999 | Weiss | |
| 6,056,709 | A | 5/2000 | Hashimoto | |
| D471,636 | S | 3/2003 | Yu | |
| D475,464 | S | 6/2003 | Chen | |
| D477,414 | S | 7/2003 | Chen | |
| D478,947 | S | 8/2003 | Lu | |
| 6,764,454 | B2 | 7/2004 | Tu | |
| 6,764,456 | B1 | 7/2004 | Doherty | 601/121 |
| D497,457 | S | 10/2004 | Willinger | |
| 7,007,978 | B1 | 3/2006 | Purdom | |
| D527,830 | S | 9/2006 | Chien | |
| 7,108,646 | B1 * | 9/2006 | Quick | A47D 13/08 482/132 |
| D573,262 | S | 7/2008 | Soucy | |
| D598,562 | S | 8/2009 | Chen | |
| D613,349 | S | 4/2010 | Metti | |
| 7,918,774 | B2 | 4/2011 | Dye | 482/132 |
| D660,450 | S * | 5/2012 | Johnson | D24/215 |
| 9,668,933 | B1 * | 6/2017 | Johnson | A61H 15/00 |
| 10,307,325 | B1 * | 6/2019 | Johnson | A61H 15/00 |
| 2002/0103415 | A1 | 8/2002 | Manska | |
| 2005/0033205 | A1 | 2/2005 | Komkin | |
| 2005/0049532 | A1 | 3/2005 | Lee | |
| 2005/0131320 | A1 | 6/2005 | Lee | 601/119 |
| 2007/0072952 | A1 | 3/2007 | Kusakawa et al. | 521/134 |
| 2007/0129654 | A1 | 6/2007 | Anderson, Jr. | 601/119 |
| 2008/0090707 | A1 | 4/2008 | Dye | 482/132 |
| 2008/0103421 | A1 | 5/2008 | Nicholson | |
| 2009/0112137 | A1 | 4/2009 | Lamore | |
| 2011/0245741 | A1 | 10/2011 | L'Homme | |
| 2011/0313333 | A1 | 12/2011 | Nicholson | |
| 2012/0065557 | A1 | 3/2012 | Phillips | 601/99 |
| 2014/0128786 | A1 * | 5/2014 | Ross | A61H 15/0092 601/118 |
| 2014/0142614 | A1 * | 5/2014 | Gallagher | A61H 7/001 606/201 |

* cited by examiner

TESSELLATED MASSAGE ROLLER

BACKGROUND

1. Technical Field

Aspects of this document relate generally to body massaging apparatuses.

2. Background

Massage rollers are often used to apply a massaging force to the human body for treatment or relaxation. Typical massage rollers mechanically interact with the human body in one of two ways. If the surface of the roller is relatively smooth, it provides a generally compressive force to soft tissue (e.g. skin, fat, fascia, muscle, connective tissue, etc.) directly below the point of contact. If the surface of the roller contains protrusions, those protrusions further concentrate the compressive force and cause localized displacement of soft tissue beneath the points of contact. In both cases, the massage roller's point of contact with the body moves as the position of the roller is displaced—either by rolling it along the body or by the person rocking or rolling against it.

Existing massage rollers aren't able to effectively emulate all massage techniques. In some instances, it is desirable to cause movement of the most superficial layers of soft tissue in a direction tangential to the skin surface, in order to create increased shear forces in the underlying tissues. This technique is sometimes called cross□friction massage. Achieving such a movement would require a massage roller to hold its point of contact with the skin while tangential forces are applied. However, existing massage rollers are not well adapted to perform such a massage.

First, the protrusions on existing massage rollers are designed to deliver compressive force to soft tissue as the roller is rolled along the body. Such protrusions would interact with more than just the superficial layers of soft tissue due to their height, and that interaction would be biased in certain directions. Directional bias is not a large concern when compressive force is the goal.

Second, the most typical surface in contact with a massage roller is lightly clothed skin. When delivering compressive force, protrusion grip is not of great importance. At most, a typical massage roller protrusion would grip the user's clothing through friction. Since the friction between skin and clothing is usually low, there would be little to no tangential movement of soft tissue.

SUMMARY

According to one aspect, a massage roller may comprise a hollow cylindrical body comprising an axis and two opposing lips extending inwardly from the cylindrical body towards the axis of the cylindrical body, a cylindrical core positioned within the cylindrical body and engaged between the two opposing lips, and a plurality of massage protrusions extending outwardly from the cylindrical body, each massage protrusion of the plurality of massage protrusions substantially centered within a different polygonal region of a polygonal tessellation of a surface of the cylindrical body, wherein each massage protrusion of the plurality of massage protrusions may comprise a base proximate the cylindrical body and separated from a base of an adjacent massage protrusion by an intermediate space that exposes a portion of the cylindrical body, a filleted peripheral edge extending around the base of the protrusion, a plurality of walls, equal in number to the edges of the polygonal region in which the protrusion is substantially centered, an axial cross-section which is substantially polygonal, said cross-section having the same number of edges as and substantially aligned with the polygonal region in which the protrusion is substantially centered, and a concave cap opposite the base.

Particular implementations and embodiments may comprise or be adapted to comprise one or more of the following. The polygonal tessellation may be monohedral. The polygonal tessellation may be pentagonal. The polygonal tessellation may include Cairo pentagonal tiling. A diameter of each massage protrusion of the plurality of massage protrusions may be defined as a diameter of a largest circle that will fit inside the axial cross-section, and each massage protrusion of the plurality of massage protrusions may comprise a height:diameter ratio ranging from 1:1 to 1:4. Each massage protrusion of the plurality of massage protrusions may comprise a height between approximately 0.125 inches and approximately 0.25 inches, and a diameter between approximately 0.25 inches and approximately 1 inch. The intermediate space may be approximately equal to the diameter of each massage protrusion of the plurality of massage protrusions. The plurality of massage protrusions may each comprise an elastomeric material comprising a blend of ethylene-vinyl acetate and polyolefin and having a durometer hardness of about 55 Asker C. The plurality of massage protrusions may each comprise an elastomeric material comprising a blend of ethylene-vinyl acetate and polyolefin and having a durometer hardness of between about 40 Asker C and about 60 Asker C.

According to another aspect, a massage roller may comprise a hollow cylindrical body comprising a center axis, a cylindrical core positioned within the cylindrical body and extending along the center axis, and a plurality of massage protrusions extending outwardly from the cylindrical body, each massage protrusion of the plurality of massage protrusions substantially centered within a different polygonal region of a polygonal tessellation of an external surface of the cylindrical body, wherein each massage protrusion of the plurality of massage protrusions may comprise a base proximate the cylindrical body and separated from a base of each adjacent massage protrusion by an intermediate space that exposes a portion of the cylindrical body, a plurality of walls, equal in number to the edges of the polygonal region in which the protrusion is substantially centered, and an axial cross-section which is substantially polygonal, said cross-section having the same number of edges as and substantially aligned with the polygonal region in which the protrusion is substantially centered.

Particular implementations and embodiments may comprise or be adapted to comprise one or more of the following. Each massage protrusion of the plurality of massage protrusions may further comprise a concave cap opposite the base. The polygonal tessellation may be monohedral. The polygonal tessellation may include a Cairo pentagonal tiling. A diameter of each massage protrusion of the plurality of massage protrusions may be defined as the diameter of the largest circle that will fit inside the axial cross-section, and each massage protrusion of the plurality of massage protrusions may comprise a height:diameter ratio ranging from 1:1 to 1:4. Each massage protrusion of the plurality of massage protrusions may comprise a height between approximately 0.125 inches and approximately 0.25 inches, and a diameter between approximately 0.25 inches and approximately 1 inch. The intermediate space may be approximately equal to the diameter of each massage protrusion of the plurality of massage protrusions. The hollow cylinder may comprise two opposing lips extending inwardly from the cylindrical body towards the axis of the cylindrical body, and the cylindrical core may be engaged between the two opposing lips. The plurality of massage protrusions may each comprise an elastomeric material comprising a blend of ethylene-vinyl acetate and polyolefin and having a durometer hardness of between about 40 Asker C and about 60 Asker C.

According to yet another aspect, a massage roller may comprise a cylindrical body comprising an axis, and a plurality of massage protrusions extending outwardly from the cylindrical body, each massage protrusion of the plurality of massage protrusions substantially centered within a different polygonal region of a polygonal tessellation of a surface of the cylindrical body, wherein each massage protrusion of the plurality of massage protrusions may comprise a base proximate the cylindrical body and separated from a base of an adjacent massage protrusion by an intermediate space that exposes a portion of the cylindrical body, a filleted peripheral edge extending around the base of the protrusion, a plurality of walls, equal in number to the edges of the polygonal region in which the protrusion is substantially centered, and an axial cross-section which is substantially polygonal, said cross-section having the same number of edges as and substantially aligned with the polygonal region in which the protrusion is substantially centered.

Particular implementations and embodiments may be adapted such that each massage protrusion of the plurality of massage protrusions further comprises a concave cap opposite the base.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, § 6. Thus, the use of the words "function," "means" or "step" in the Detailed Description or Description of the Drawings or claims is not intended to somehow indicate a desire to invoke the special provisions of 35 U.S.C. § 112, § 116, to define the invention. To the contrary, if the provisions of 35 U.S.C. § 112, § 116 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112, § 116. Moreover, even if the provisions of 35 U.S.C. § 112, § 116 are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The inventions will hereinafter be described in conjunction with the appended drawings, where like designations denote like elements, and.

DESCRIPTION

This disclosure, its aspects, embodiments, and implementations, are not limited to the specific components or assembly procedures disclosed herein. Many additional components and assembly procedures known in the art consistent with the intended massage rollers and/or assembly procedures for massage rollers will become apparent for use with implementations of massage rollers from this disclosure. Accordingly, for example, although particular massage rollers are disclosed, such massage rollers and implementing components may comprise any shape, size, style, type, model, version, measurement, concentration, material, quantity, and/or the like as is known in the art for such massage rollers and implementing components, consistent with the intended operation of massage rollers.

Figure 1:
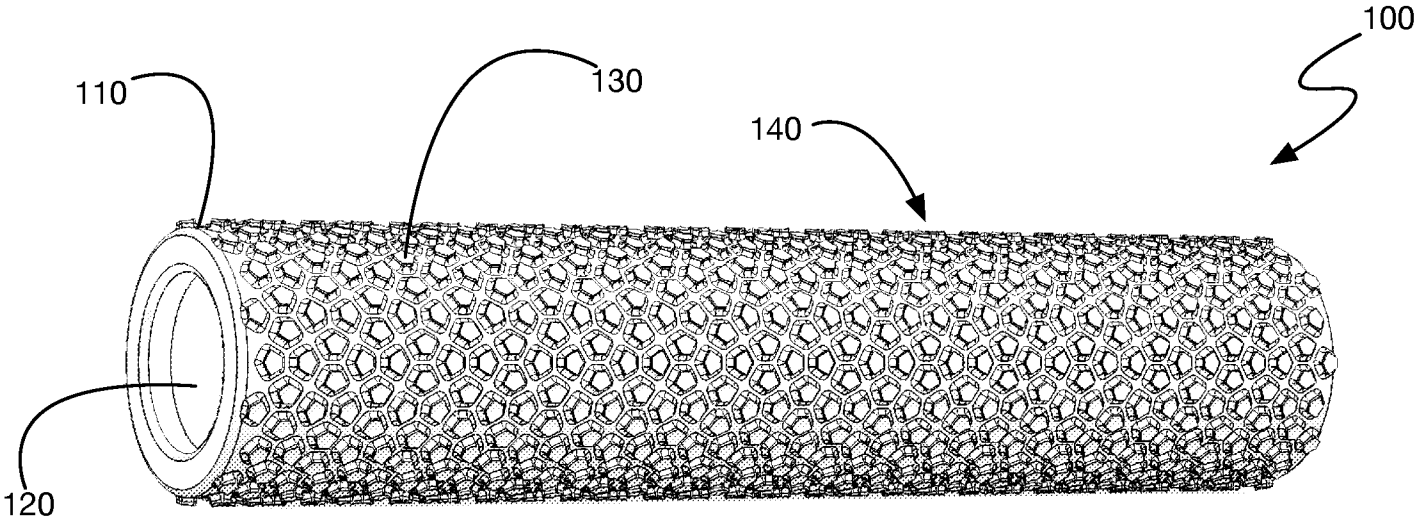
FIG. 1 is a perspective view of a tessellated massage roller.
Figure 2:
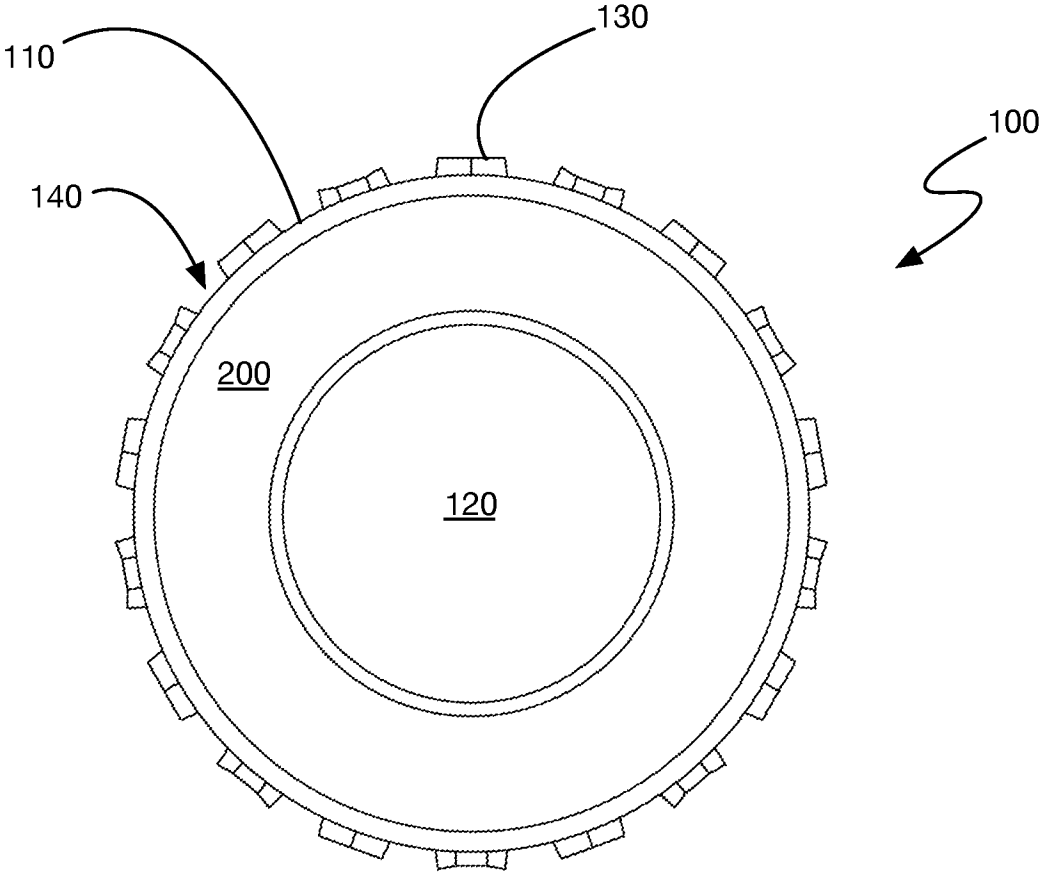
FIG. 2 is an end view of a tessellated massage roller.
Figure 3:
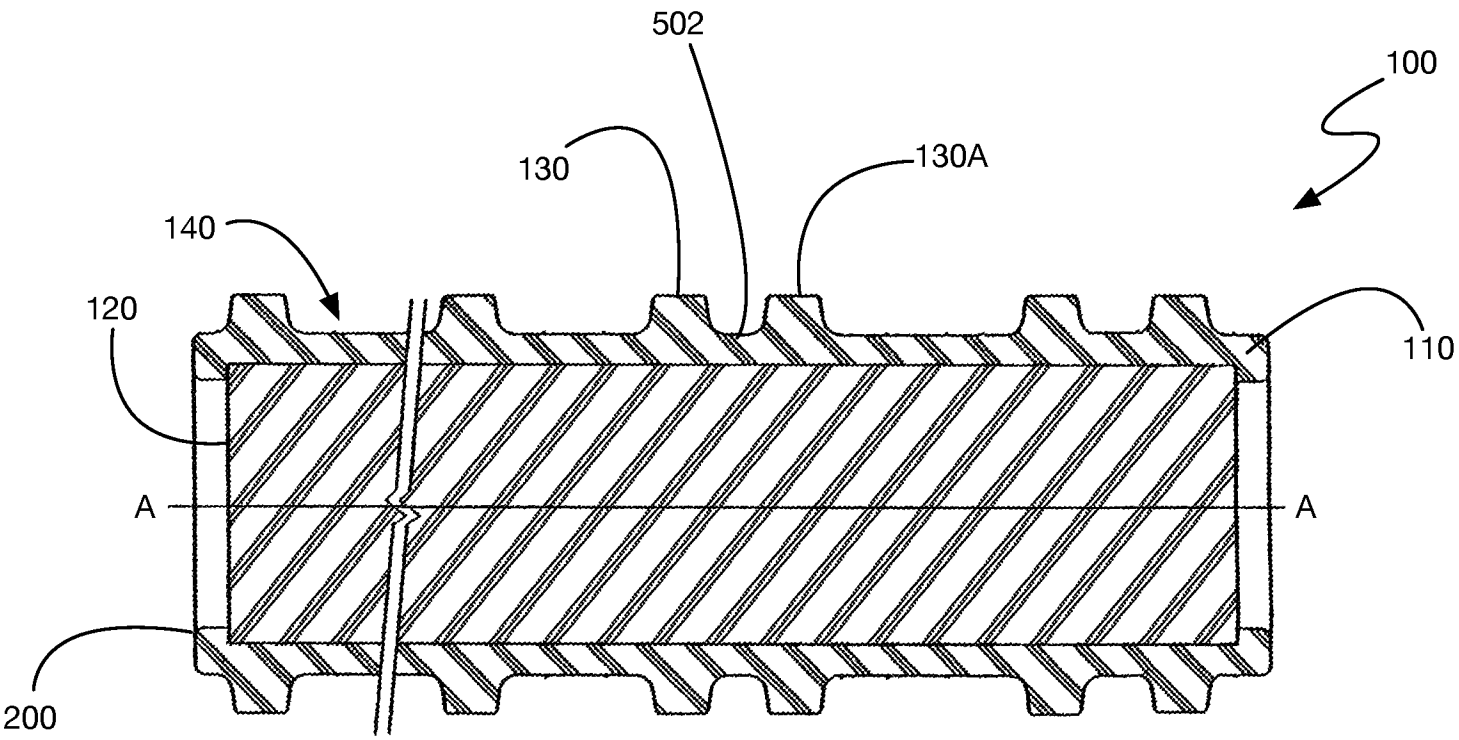
FIG. 3 is a longitudinal cross-section view of a tessellated massage roller.

FIGS. 1 through 3 depict a non-limiting embodiment of a tessellated massage roller 100, having a hollow cylindrical body 110, a cylindrical core 120, and a plurality of massage protrusions 130. As shown, a cylindrical core 120 is positioned within the hollow cylindrical body 110, and engaged between two opposing lips 200 of the body 110 which extend inward from the body 110 towards the axis A-A (FIG. 3). Entrapping the core 120 within the cylindrical body 110 using the two opposing lips 200 eliminates or reduces the need for adhesive bonding or overmolding processes often used in typical massage rollers.

In other embodiments, the cylindrical core 120 may be affixed inside the hollow cylindrical body 110 without the use of opposing lips 200. In still other embodiments, the massage roller 100 may comprise a single, solid cylindrical body. The cylindrical core 120 may be hollow, or it may have a solid construction as shown in FIG. 3. Adhesive may or may not be used depending upon the needs of a particular design.

While implementations may comprise a variety of materials including, but not limited to, rubbers, foams, plastics, inflatables, and the like, in a particular implementation the cylindrical core 120 comprises ethylene-vinyl acetate (EVA) foam having a durometer hardness of between 30 to 60 Asker C. A solid EVA foam core is advantageous to conventional cores comprising polyvinyl chloride (PVC) or acrylonitrile butadiene styrene (ABS) because PVC and ABS are relatively brittle plastics, resulting in cracking and breaking cores responsive to high load or long term fatigue stresses. EVA foam solves this problem because it is rubber-like, and resists cracking under stress. This allows an EVA foam core 120 to compress rather than crack under a load.

The cylindrical body 110 may be molded from an elastomeric material such as natural or synthetic rubber. Exemplary materials are Neoprene®, Buna-N, silicone, polyurethane, EPDM, SBR, vinyl, butyl or synthetic foams such as polyethylene, EVA and polyolefins. In various embodiments, the cylindrical body 110 may comprise a blend of EVA and a polyolefin having a durometer hardness of between 30 to 60 Asker C. More particularly, a cylindrical body 110 may comprise a blend of EVA and polyolefin having a hardness of between 40 and 50 Asker C. In other embodiments, a cylindrical body 110 may comprise a blend of EVA and polyolefin having a hardness of between about 40 and about 60 Asker C. In other embodiments, the cylindrical body 110 may comprise a blend of EVA and polyolefin having a durometer hardness of 55 Asker C. In still other embodiments, the cylindrical body 110 may comprise a blend of EVA and polyolefin having a durometer hardness of 60 Asker C. The size of the roller 100 may vary, but typically for most applications is approximately 4" to 6" in diameter and 12" to 36" in length. Other sizes and hardnesses may be used depending upon the particular size and weight of the user, the particular area of the body being treated, and the particular massage therapy being administered.

FIGS. 1-3 illustrate a plurality of massage protrusions 130 extending outwardly from the cylindrical body 110. As shall be described in greater detail with respect to FIGS. 6-7, each massage protrusion 130 includes a base 600, a filleted peripheral edge 602, a plurality of walls 604, and a concave cap 606, according to various embodiments. The number of walls 604 and their geometry within each massage protrusion 130, as well as the location of each protrusion 130 on the cylindrical body 110, is governed by a polygonal tessellation 400 of the surface 140 of the cylindrical body.

A cross-friction massage causes movement of the most superficial layers of soft tissue in a direction tangential to the skin surface, which in turn creates increased shear forces in the underlying tissues. Achieving such a movement would require a massage roller to hold its point of contact with the skin while tangential forces are applied. Since the most common surface to which a massage roller is applied is skin covered in light clothing, the grip of the massage protrusions must rely on more than just friction, which would simply move the user's clothing without gripping their skin.

The geometry of the massage protrusions of a massage roller may be optimized to grip the superficial layers of soft tissue through light clothing. According to various embodiments, and as shown in the Figures of this disclosure, one such optimization is the use of a concave cap. A concave cap 606 of a massage protrusion 130 will be described in greater detail with respect to FIG. 6.

The grip provided by the concave cap 606 may be maximized in a direction normal to an edge of the concave cap 606, and is proportional to the length of the edge which is in contact. Furthermore, it is desirable for the massage roller 100 to provide a consistent feel for the user, in all directions. A circular concave cap would provide a similar feel in all directions, but would have reduced grip, as the length of the edge of the cap in contact would have many normal directions. A massage protrusion with a concave cap and a polygonal cross-section is desirable to balance grip with directional independence.

Massage protrusions with polygonal cross-sections may be arranged with close and consistent spacing by using a polygonal tessellation, or tiling. In the context of the present description, a tessellation is a tiling of shapes on a surface such that there are no gaps or overlapping. Tessellations are often described as coving a planar surface; the following descriptions of different tessellations will be done in the context of a planar surface. However, these planar tessellations may be adapted to be wrapped around the curved surface of a massage roller 100. In some embodiments, such a wrapping may be done so the tiling pattern is unbroken around the circumference of the massage roller, and extends the length of the massage roller.

Figure 4:
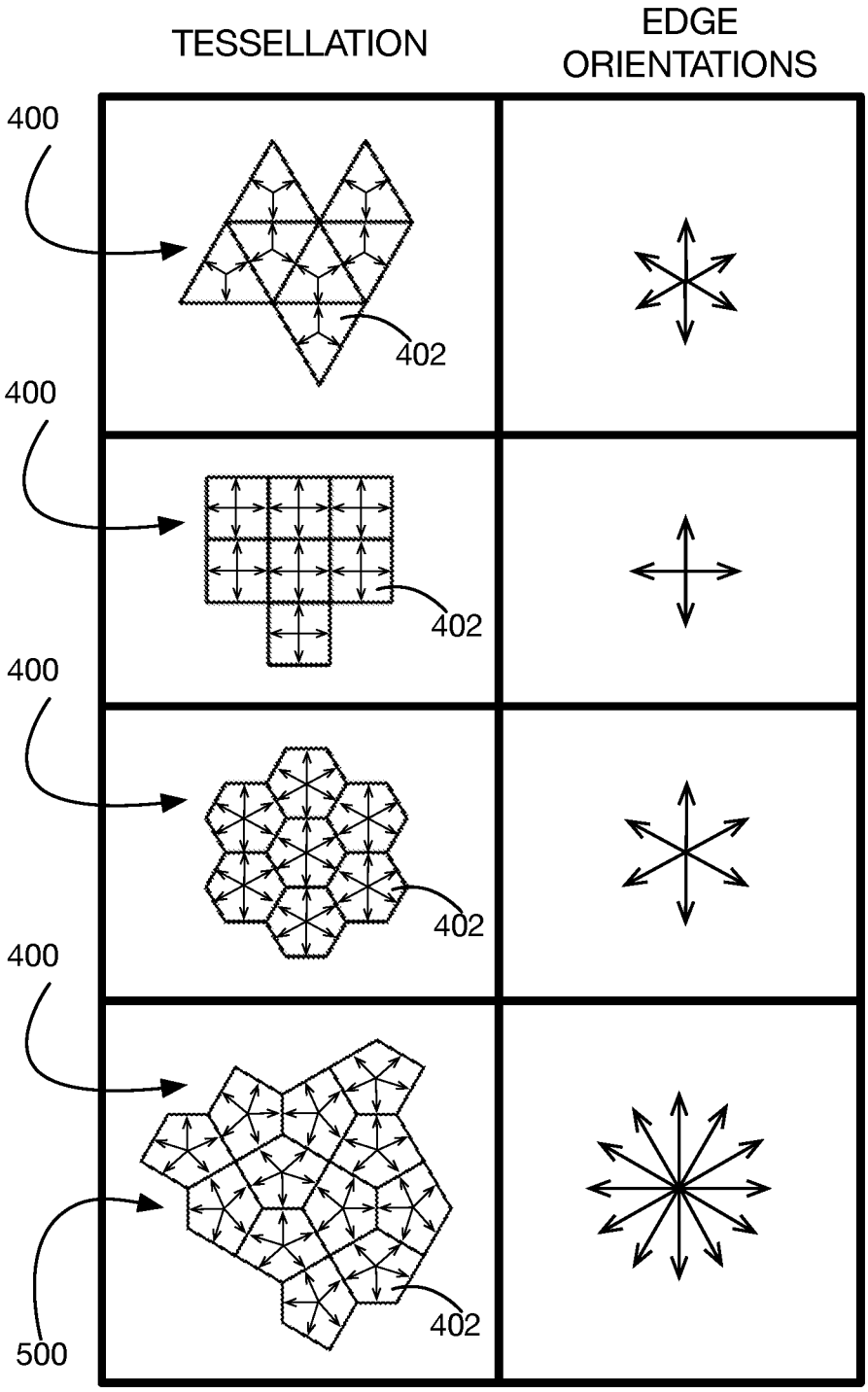
FIG. 4 is a table of exemplary polygonal tessellations.

FIG. 4 is a table illustrating a number of exemplary polygonal tessellations 400 made up of triangular, square, hexagonal, and pentagonal polygonal regions 402. FIG. 4 is just a small sample of the various tessellations that could be used to partition the surface of a massage roller 100. In some embodiments, the polygonal tessellation 400 of massage roller 100 is monohedral (i.e. made up of a single shape), such as the polygonal regions 402 shown in FIG. 4. The use of a monohedral tessellation may aid in providing a consistent feel to the user. In other embodiments, the polygonal tessellation 400 may comprise two or more polygonal regions of different shape, size, and/or number of sides.

The table of FIG. 4 also illustrates the edge orientations associated with the polygonal tessellations 400 listed. Since the polygonal regions 402 of each tessellation may be held in different orientations, the "average" edge orientation shown may have more directions than a single region. See, for example, the triangular tessellation, which has, on average, six edge orientations provided by multiple three-edged triangular polygonal regions. As previously discussed, these edge orientations are the directions in which grip is maximized for the concave cap 606 of the massage protrusions 130.

In a particular embodiment, a tessellated massage roller 100 employs the pentagonal tessellation known as the Cairo pentagonal tiling 500. A pentagonal tessellation may be advantageous over other polygonal regions because it can be tiled in such as way that the average edge orientations cover many directions without having to increase the number of sides of the tile, which would decrease the edge length and gripping power, as previously discussed. A square or rectangular monohedral tiling would be limited in the number of edge orientations, and a hexagonal tiling would have smaller edges than a pentagonal tiling of the same density.

Figure 5A:
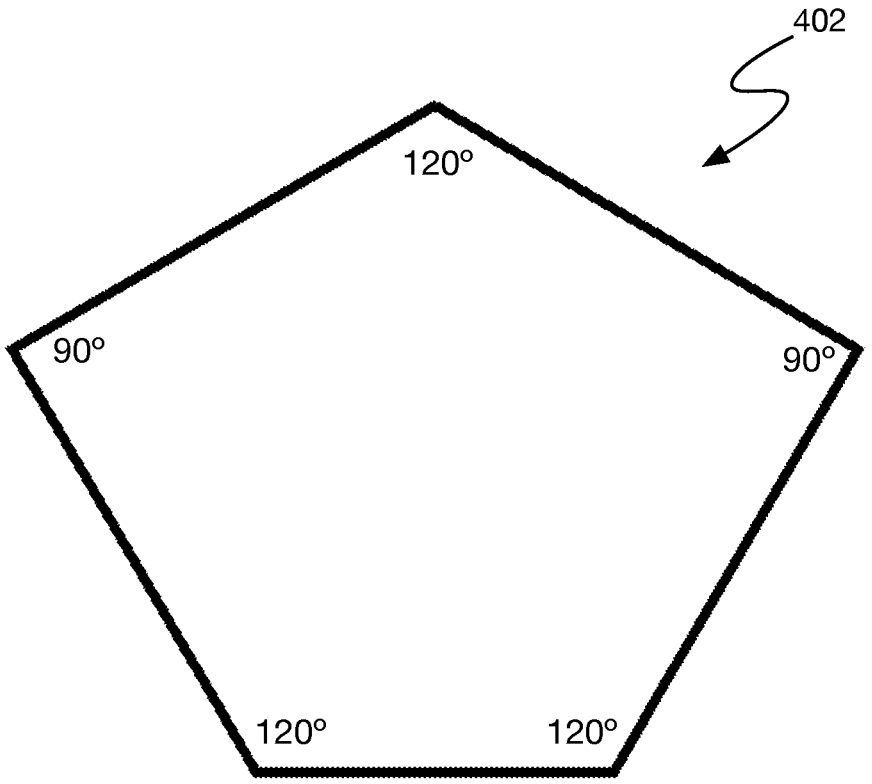
FIG. 5A is a top view of an irregular pentagon.

While a regular pentagon (i.e. five sides of equal length) cannot tile a plane, a number of pentagonal tilings exist using irregular pentagons. The pentagonal tile (e.g. polygonal region 402) making up the Cairo pentagonal tiling is shown in FIG. 5A.

The Cairo pentagonal tiling is advantageous over other pentagonal tilings due to it having the least perimeter length per unit area than all other pentagonal tilings except the prismatic pentagonal tiling, with which it is equal. In other words, the pentagon illustrated in FIG. 5A is closer to being a regular pentagon than those other pentagonal tilings, resulting in greater directional independence. Furthermore, the Cairo pentagonal tiling has more edge orientations than the prismatic pentagonal tiling.

Figure 5B:
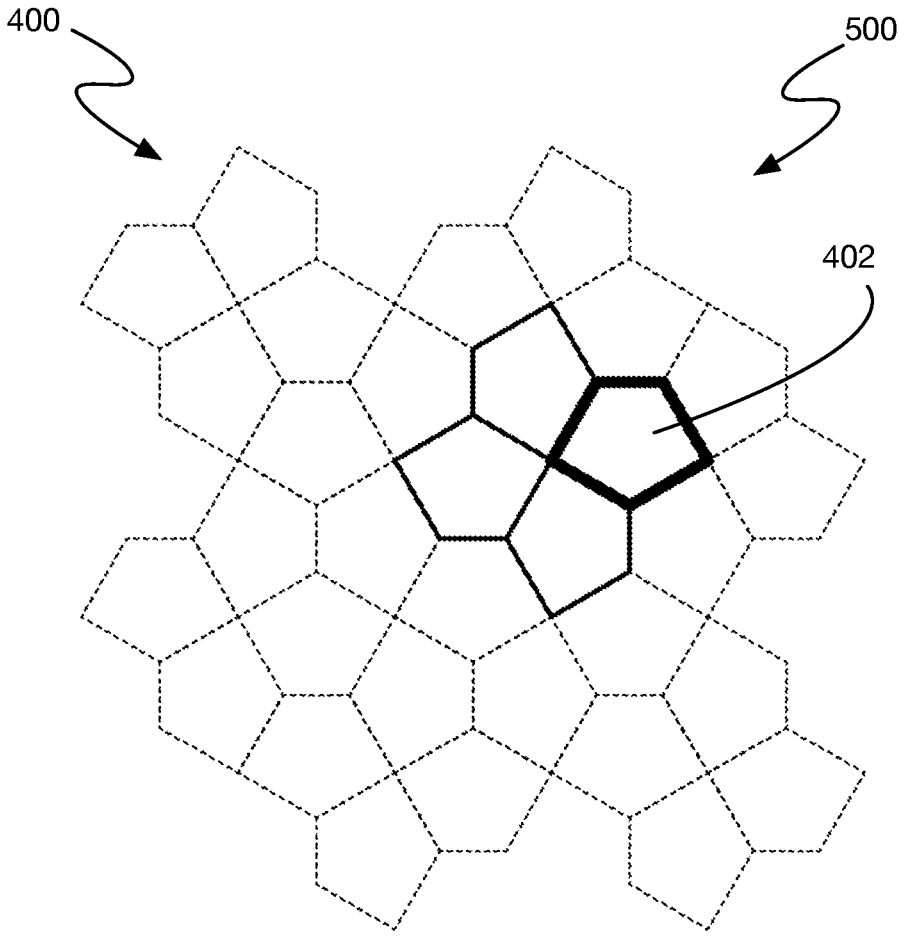
FIG. 5B is a top view of a Cairo pentagonal tiling.
Figure 5C:
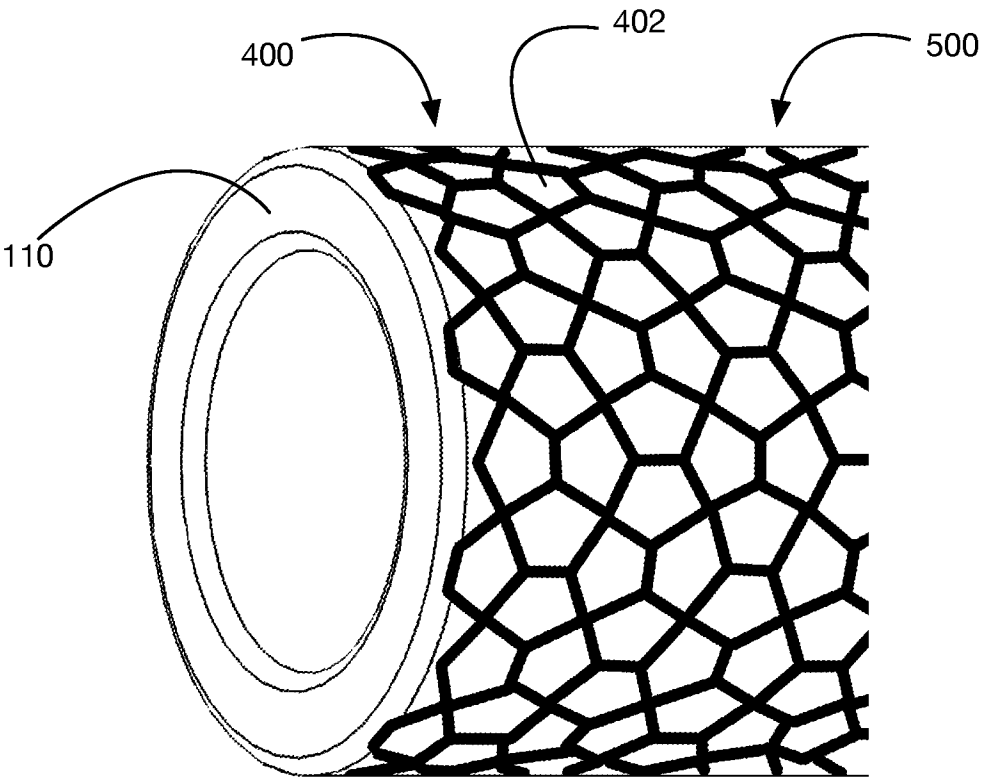
FIG. 5C is a perspective view of a Cairo pentagonal tiling projected on a cylindrical body.

FIG. 5B illustrates a plane tessellated with a Cairo pentagonal tiling 500. A group of four polygonal regions 402 are highlighted to illustrate a cell which has simple translational repetition (i.e. repeated without rotation). FIG. 5C shows a perspective view of the Cairo pentagonal tiling 500 of FIG. 5B projected on the surface of a cylindrical body.

Figure 5D:
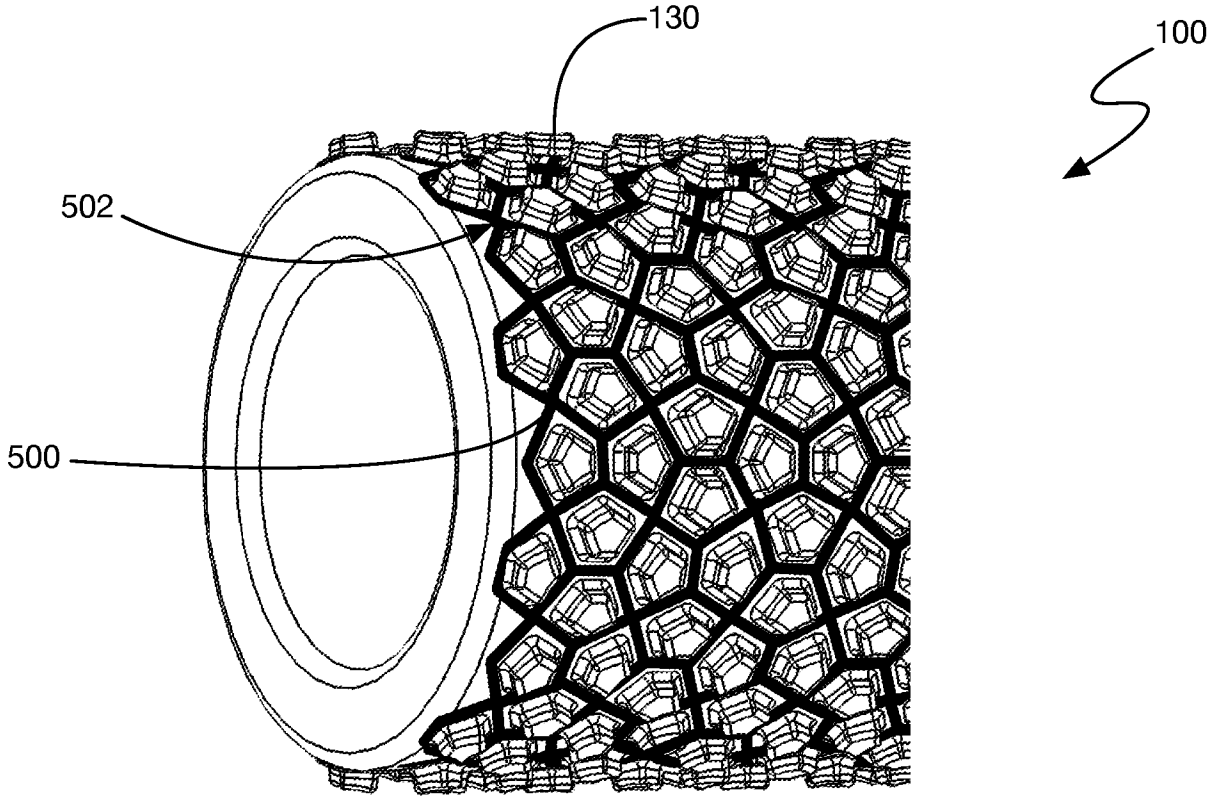
FIG. 5D is a perspective view of a Cairo pentagonal tiling projected on a tessellated massage roller.
Figure 5E:
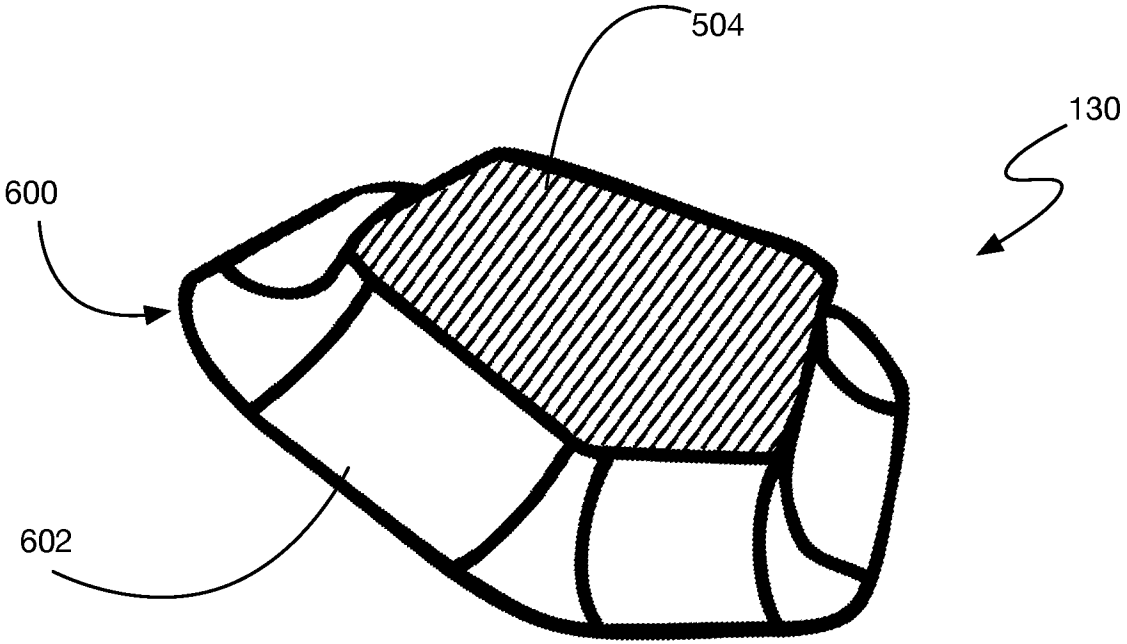
FIG. 5E is a perspective view of a massage protrusion partially cut away to demonstrate an axial cross-section.

FIGS. 5D and 5E illustrate an embodiment of a tessellated massage roller 100 employing a Cairo pentagonal tiling 500. FIG. 5D illustrates a perspective view of a Cairo pentagonal tiling 500 projected on a tessellated massage roller 100, in accordance with various embodiments. As shown, each massage protrusion 130 is substantially centered within and substantially aligned with a polygonal region 402 of the polygonal tessellation 400 (e.g. Cairo pentagonal tiling 500). Each massage protrusion 130 is separated from each immediately adjacent massage protrusion 130A by an intermediate space 502. The intermediate space 502 will be discussed in greater detail with respect to FIG. 9.

FIG. 5E illustrates that the massage protrusions 130 have an axial cross-section 504 which is the same shape and number of sides as the pentagon of FIG. 5A. It should be noted that FIGS. 5D and 5E illustrate one embodiment of a tessellated massage roller 100. Other embodiments may employ different tessellations, including but not limited to those previously discussed.

The protrusions 130 are each substantially centered within and substantially aligned with the polygonal regions 402 which make up the polygonal tessellation 400 (e.g. Cairo pentagonal tiling 500). While defining these terms, any mention of the axial cross-section 504 of a protrusion 130 will assume that the cross-section 504 has been projected to be co-planar with the polygonal region 402, so the height at which the cross-section 504 is taken does not affect the distances and angles used to define "substantially centered within" and "substantially aligned with".

In the context of the present description and the claims that follow, "substantially centered within" refers to an arrangement of a protrusion 130 within a polygonal region 402 such that the distance between the centroid of the polygonal region 402 and the centroid of the axial cross-section 504 is within 50% of the diameter 900 of the protrusion 130. The diameter 900 will be discussed in greater detail with respect to FIG. 9.

Furthermore, in the context of the present description and the claims that follow, "substantially aligned with" refers to an arrangement of a protrusion 130 within a polygonal region 402 such that an edge of the polygonal region 402 and the nearest edge of the axial cross-section 504 are roughly parallel (i.e. within 15° of parallel) for all edges. Such evaluations of relative orientation are performed from near the middle of the edges, to discount any rounding of the vertices of the axial cross-section 504.

Figure 6:
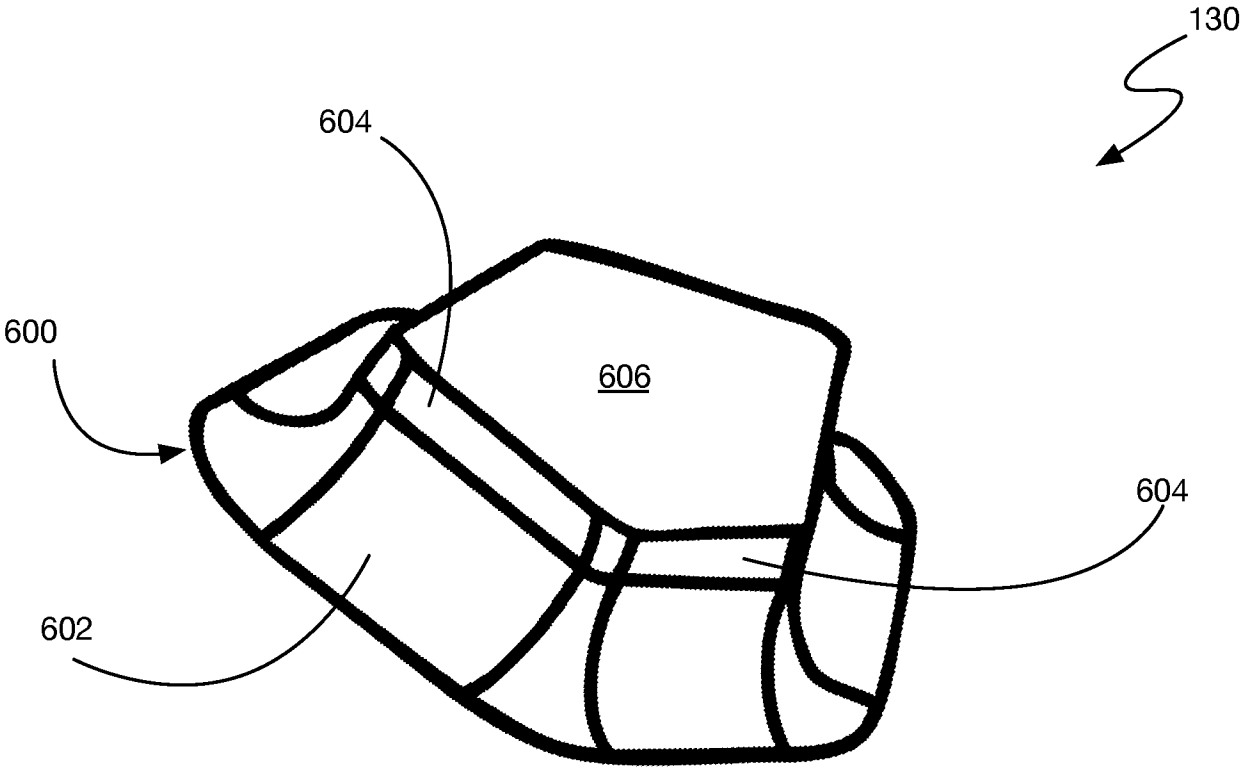
FIG. 6 is a perspective view of a massage protrusion.

Referring now to FIG. 6, a perspective view of a massage protrusion 130 is illustrated. Each massage protrusion 130 has a base 600 and a plurality of walls 604. The massage protrusion 130 shown in FIG. 6 is part of a massage roller 100 employing a Cairo pentagonal tiling, and thus has five walls 604. The walls smoothly transition into the surface 140 of the cylindrical body 110 at a filleted peripheral edge 602 extending around the base 600 of each protrusion 130.

Figure 7:
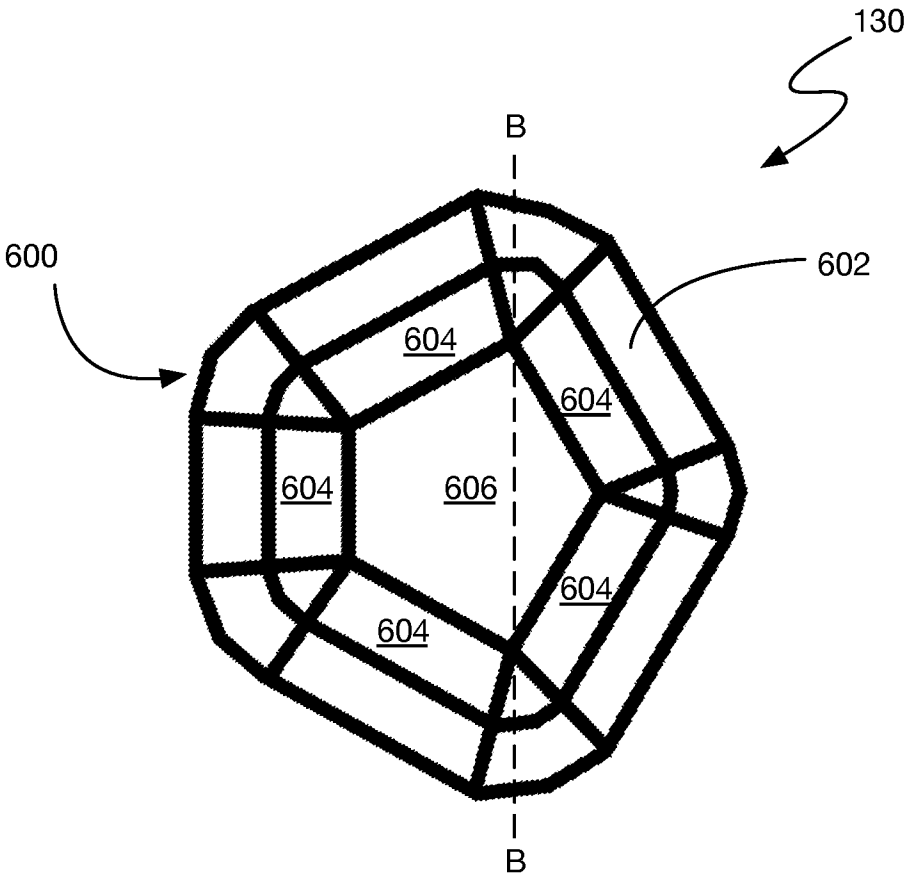
FIG. 7 is a top view of a massage protrusion.

As shown in FIGS. 6 and 7, each massage protrusion 130 comprises a concave cap 606, with the surface of the cap 606 recessing below the periphery of the cap 606. As previously discussed, the concave cap 606 allows the massage protrusion 130 to grip the user's most superficial layers of soft tissue, through a layer of light clothing. The concave nature of the concave cap 606 results in sharp distal edges (e.g. sharper than those found in traditional massage rollers, etc.) at the top of the protrusion 130, which in turn provide better grip. In some embodiments, the sharp distal edges are accomplished with the use of concave caps 606. In other embodiments, the distal edges of the top of the protrusions 130 may be sharpened by reducing the draft angle of the walls and/or reducing the radius of the edges.

In some embodiments, the concave nature of the cap 606 is such that the edges and vertices of the cap 606 are of equal height, and slope inward to a sunken center. In other embodiments, the vertices of the polygonal shaped cap 606 are peaks, with the edges sloping downward between the vertices, and the edges and vertices all sloping even further down toward the sunken center. In other words, the edges droop between the vertices, but the sunken center of the cap 606 is lower than them all. This may help reduce or prevent a suction from forming between the concave cap 606 and a hard smooth surface, such as a floor, while the massage roller is in use. In still other embodiments, the concave cap 606 may have vertices and edges of different heights, yet all slope downward to the sunken center.

In some embodiments, the transition from one wall 604 to another may be gradual, the axial cross-section having rounded corners rather than sharp vertices. In other embodiments, the transitions may be sharp, without any rounding.

Figure 8A:
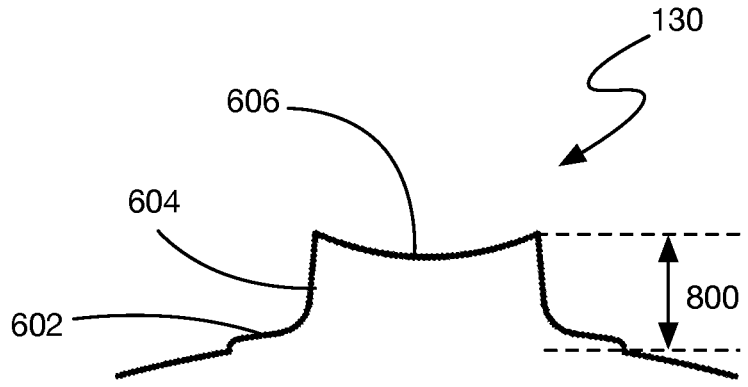
FIG. 8A is a cross-sectional view of a first implementation of a massage protrusion taken along line B-B of FIG. 7.
Figure 8B:
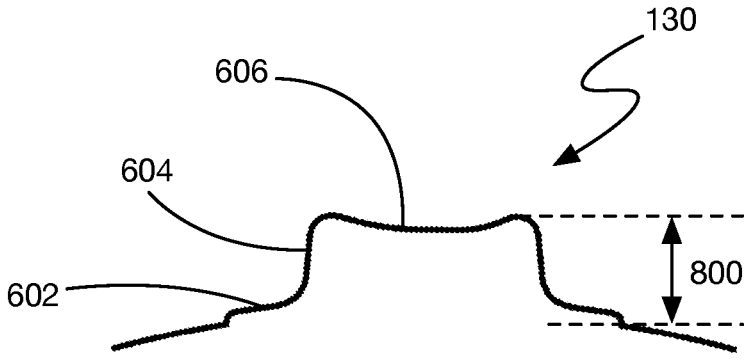
FIG. 8B is a cross-sectional view of a second implementation of a massage protrusion taken along line B-B of FIG. 7.

Referring now to FIG. 8A, a cross-sectional view of a first implementation of a massage protrusion 130, taken along line B-B of FIG. 7. FIG. 8B is the same view of a second implementation of a massage protrusion 130. It should be noted that the line B-B of FIG. 7 crosses two peaks of the concave cap 606; therefore, the cross-sections illustrated in FIGS. 8A and 8B do not include the edges of the cap 606, which may or may not also be concave in nature, according to various embodiments.

In particular embodiments, the massage protrusions 130 of a massage roller 100 are formed tall enough to positively engage the user's skin and clothing, yet not so tall that they engage more than the superficial layers of soft tissue. Furthermore, the protrusions 130 may be formed to resist side-to-side flexion, resulting from a desirable so a low height to diameter ratio. The diameter 900 of a massage protrusion and the height-to-diameter ratio will be discussed in greater detail with respect to FIG. 9. Thus, the particular height of a massage protrusion 130 may depend upon, among other things, the chosen diameter 900 of the protrusion and the stiffness of the material of the protrusion.

As shown, the height 800 of a massage protrusion 130 is measured from the surface 140 of the cylindrical body 110 to the highest point of the concave cap 606. According to various embodiments, the height at which the axial cross-section 504 is taken is at the top of the filleted peripheral edge 602.

As stated before, the particular dimensions of a massage protrusion 130 may depend on a number of factors. In a particular embodiment, the height 800 of the protrusions is between approximately 0.125 inches and approximately 0.25 inches. In other embodiments, the height may be greater or smaller, depending on the factors previously discussed.

FIG. 8A illustrates a first implementation of a concave cap 606 which has sharp peaks. In some embodiments, the peaks and/or edges of a concave cap 606 may be sharp, to better grip the user's skin through a layer of clothing. FIG. 8B illustrates a second implementation of a concave cap 606 in which the peaks have a slight radius. In some embodiments, the peaks and edges of a concave cap 606 may have a small radius due to the method of manufacture.

Figure 9:
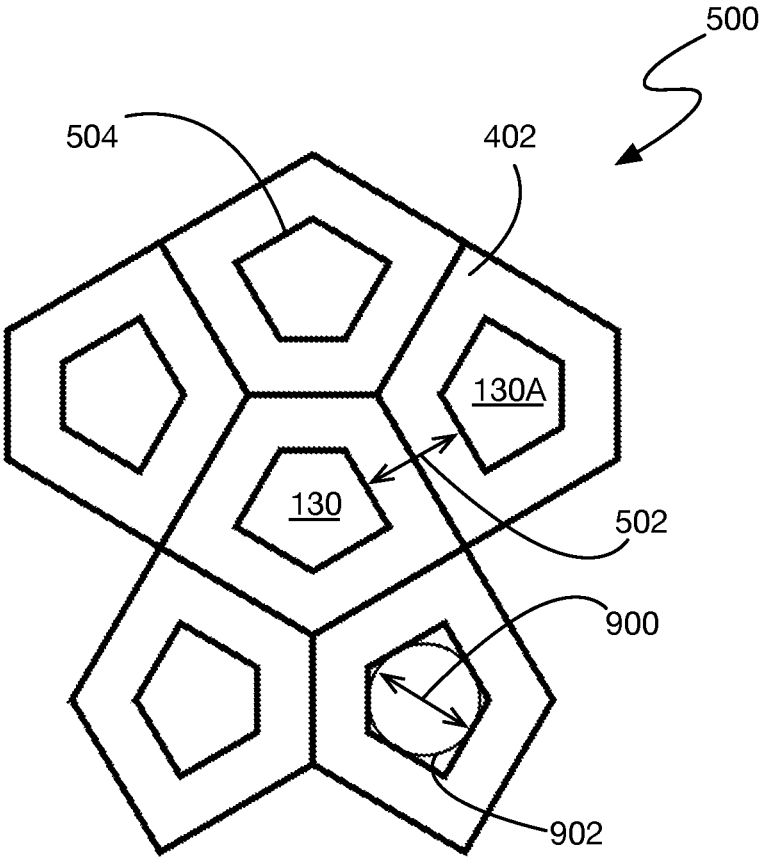
FIG. 9 is a top schematic view of a Cairo pentagonal tiling of massage protrusions.

Referring now to FIG. 9, a schematic top view of a Cairo pentagonal tiling 500 of massage protrusions 130 is illustrated. For clarity, the filleted peripheral edges 602 shown in FIG. 6 are not shown in FIG. 9. As indicated, the diameter 900 of a massage protrusion 130 is defined as the diameter of the largest circle (e.g. circle 902) that will fit inside the axial cross-section 504.

For effective use, a number of needs may be balanced. First, the massage protrusions 130 may to be spaced far enough apart to provide sufficient space for displaced skin and clothing. As shown, the intermediate space 502 is the separation between a massage protrusion 130 and an adjacent massage protrusion 130A. In the context of the present description and the claims that follow, the adjacent massage protrusions are those immediately adjacent to a particular massage protrusion. In a particular embodiment, the intermediate space 502 is approximately equal to the diameter 900 of a massage protrusion 130. As used herein and in the claims that follow, the term "approximately equal", when referring to intermediate space 502, means that the shortest distance between the edges of the two adjacent massage protrusions 130 is 15% larger than or smaller than the diameter 900 of the massage protrusion. In other embodiments, the intermediate space 502 may be different to meet the needs of a particular implementation. For example, users with thick clothing or thicker superficial layers of soft tissue may benefit from a larger intermediate space 502.

Second, since the contact area between a massage roller 100 and a user can be as small as a few square inches, the massage protrusions 130 may be formed small enough, and packed dense enough, to ensure that enough massage protrusions 130 engage with the user in enough different orientations to provide an effective massage with a consistent feel. Thus, the ideal diameter may depend upon the tessellation employed as well as the spacing between the massage protrusions. In a particular embodiment, the diameter 900 of a massage protrusion 130 is between approximately 0.25 inches and approximately 1 inch. In other embodiments, smaller or larger protrusion diameters may be used, depending upon the materials used, the tessellation employed, and the characteristics of the intended user.

Finally, the height-to-diameter ratio of the massage protrusions may be formed small enough that the protrusions resist side-to-side flexion to provide sufficient tangential force to the superficial layers of soft tissue. The resistance of side-to-side flexion depends upon the geometry of the massage protrusion, as well as the materials used to make it. Thus, the ideal ratio may depend upon what materials are used. In a particular embodiment, the height-to-diameter ratio of a massage protrusion 130 ranges from 1:1 to 1:4. In other embodiments, depending on the materials used and the characteristics of the user (e.g. some users may need the application of greater tangential forces than others, etc.), other ratios may be advantageous.

FIG. 9 shows a top view of the massage protrusions 130. In some embodiments, the walls 604 (FIG. 6) of a massage protrusion 130 may be approximately vertical between the filleted peripheral edge 602 and the concave cap 606. In other embodiments, the walls 604 may taper upwards, such that the diameter of the concave cap 606 is smaller than the diameter of the base 600.

Figure 10:
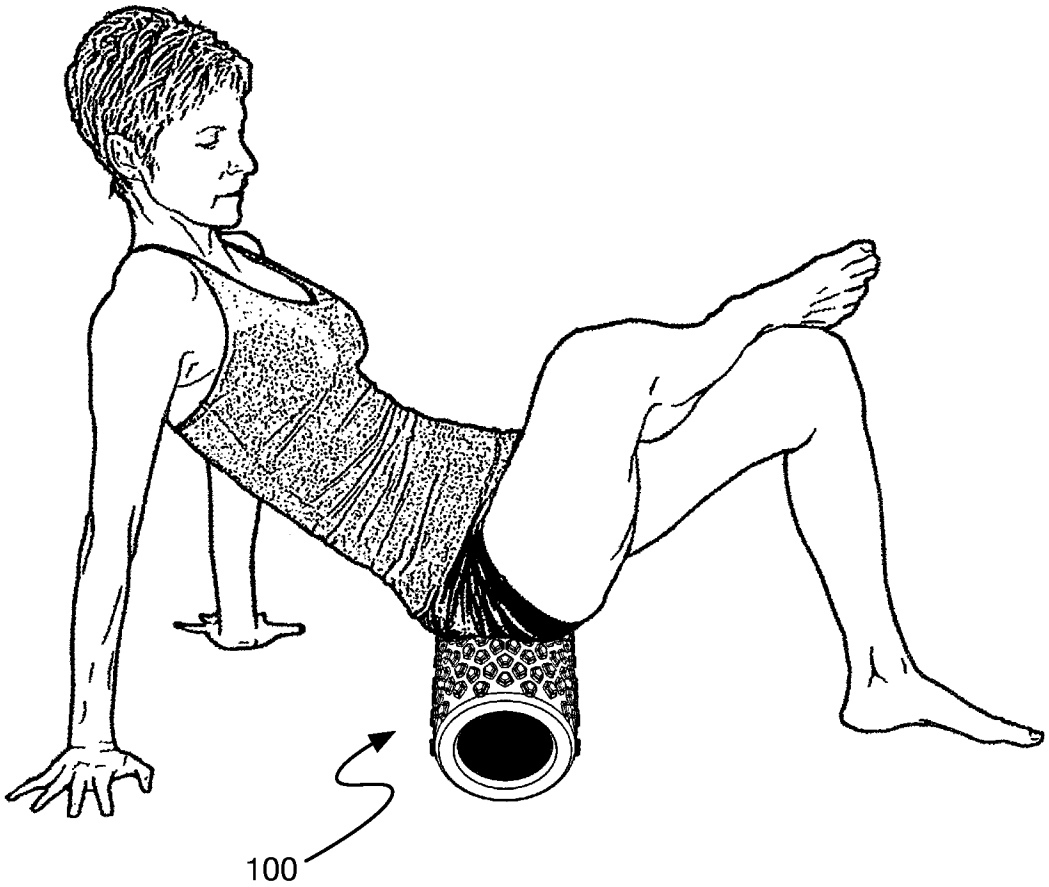
FIG. 10 is a perspective view of an exemplary use of a tessellated massage roller.

Referring now to FIG. 10, illustrating an exemplary use of a massage roller 100. Although the massage roller 100 illustrated in FIG. 10 employs the Cairo pentagonal tiling 500, any tessellation discussed herein may be utilized in similar fashion. The massage roller 100 may be placed between a user and a surface, such as a floor, wall, ground, door, etc. Due to the polygonal tessellation 400 governing the shape and placement of the massage protrusions 130, the massage roller 100 applies consistent and effective tangential forces to the superficial layers of the user's soft tissue as the user shifts against the stationary roller. These tangential forces create increased shear forces in the underlying tissues. The application of such forces is facilitated by the concave cap 606 at the end of each massage protrusion 130, which grips the superficial layers of the user's soft tissue through their clothing.

In places where the description above refers to particular implementations of massage rollers, it should be readily apparent that a number of modifications may be made without departing from the spirit thereof and that these implementations may be applied to other massage apparatuses. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A massage roller comprising:

a hollow cylindrical body comprising an axis and two opposing lips extending inwardly from the hollow cylindrical body towards the axis of the hollow cylindrical body;

a cylindrical core positioned within the hollow cylindrical body and engaged between the two opposing lips; and a plurality of irregular pentagonal massage protrusions extending outwardly from the hollow cylindrical body, each irregular pentagonal massage protrusion of the plurality of irregular pentagonal massage protrusions substantially centered within a different irregular pentagonal region of a Cairo pentagonal tessellation of a surface of the hollow cylindrical body, the Cairo pentagonal tessellation configured to provide average edge orientations covering directions for improved grip;

wherein each irregular pentagonal massage protrusion of the plurality of irregular pentagonal massage protrusions comprises:

a base proximate the hollow cylindrical body and separated from a base of an adjacent irregular pentagonal massage protrusion by an intermediate space that exposes a portion of the hollow cylindrical body;

a filleted peripheral edge extending around the base of the protrusion;

a plurality of walls, equal in number to a number of edges of the irregular pentagonal region in which the protrusion is substantially centered;

an axial cross-section which is substantially polygonal, said axial cross-section having a number of edges that is equal to the number of edges of the irregular pentagonal region and each of the edges of said axial cross section is substantially aligned with each of the edges of the irregular pentagonal region, respectively; and a concave cap opposite the base, the concave cap comprising a periphery and a surface recessed below the periphery, such that the concave cap is configured to provide improved grip of a user's most superficial layers of soft tissue.

2. The massage roller of claim 1:

wherein a diameter of each irregular pentagonal massage protrusion of the plurality of irregular pentagonal massage protrusions is defined as a diameter of a largest circle that fits inside the axial cross-section, and wherein each irregular pentagonal massage protrusion of the plurality of irregular pentagonal massage protrusions comprises a height and a height:diameter ratio ranging from 1:1 to 1:4.

3. The massage roller of claim 2, wherein the height of each irregular pentagonal massage protrusion of the plurality of irregular pentagonal massage protrusions is between approximately 0.125 inches and approximately 0.25 inches, and the diameter is between approximately 0.25 inches and approximately 1 inch.

4. The massage roller of claim 2, wherein the intermediate space is approximately equal to the diameter of each irregular pentagonal massage protrusion of the plurality of irregular pentagonal massage protrusions.

5. The massage roller of claim 1, wherein the plurality of irregular pentagonal massage protrusions each comprises an elastomeric material comprising a blend of ethylene-vinyl acetate and polyolefin and having a durometer hardness of about 55 Asker C.

6. The massage roller of claim 1, wherein the plurality of irregular pentagonal massage protrusions each comprises an elastomeric material comprising a blend of ethylene-vinyl acetate and polyolefin and having a durometer hardness of between about 40 Asker C and about 60 Asker C.

* * * * *